US009624073B2

(12) United States Patent
Roivainen et al.

(10) Patent No.: US 9,624,073 B2
(45) Date of Patent: Apr. 18, 2017

(54) METHOD AND ELEVATOR ARRANGEMENT

(71) Applicant: KONE CORPORATION, Helsinki (FI)

(72) Inventors: Gabriela Roivainen, Hyvinkää (FI); Giovanni Hawkins, Helsinki (FI); Mikko Vesterinen, Helsinki (FI)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 14/843,666

(22) Filed: Sep. 2, 2015

(65) Prior Publication Data

US 2016/0090274 A1 Mar. 31, 2016

(30) Foreign Application Priority Data

Sep. 25, 2014 (EP) ..... 14186302

(51) Int. Cl.
*B66B 11/02* (2006.01)

(52) U.S. Cl.
CPC ..... *B66B 11/0273* (2013.01)

(58) Field of Classification Search
CPC B66B 11/0273; B66B 11/028; B66B 11/0286
USPC ..... 187/401
See application file for complete search history.

(56) References Cited

U.S. PATENT DOCUMENTS 5,005,671 A * 4/1991 Aime ..... B66B 11/0273 187/345
5,027,925 A * 7/1991 Kahkipuro ..... B66B 11/0286 187/292
5,294,757 A * 3/1994 Skalski ..... B66B 1/44 187/393
5,402,861 A * 4/1995 Kohara ..... B66B 11/0286 187/292
5,439,075 A * 8/1995 Skalski ..... B66B 1/44 187/298
5,584,364 A * 12/1996 Sakita ..... B66B 7/06 187/249
5,811,743 A * 9/1998 Kohara ..... B66B 7/046 187/292
6,351,096 B1 * 2/2002 Jang ..... B66B 25/00 187/292
6,450,299 B1 * 9/2002 Lysaght ..... B66B 1/3484 187/393

(Continued)

FOREIGN PATENT DOCUMENTS

EP 1 342 691 A1 9/2003

*Primary Examiner* — Michael Riegelman
(74) *Attorney, Agent, or Firm* — Birch, Stewart, Kolasch & Birch, LLP

(57) ABSTRACT

A method for balancing an elevator car including a frame; a cabin box mounted on the frame; and a plurality of elastic members, such as springs, in vertical direction between the frame and the cabin box, via which elastic members the cabin box rests on the frame. The method includes measuring the vertical distance between the frame and the cabin box in several horizontally spaced apart locations with distance sensors; and adjusting the weight distribution of the cabin box by adding and/or removing weight elements on the cabin box. An arrangement for balancing an elevator car is provided to implement the method.

20 Claims, 3 Drawing Sheets

(56) References Cited

U.S. PATENT DOCUMENTS

| | | | | |
|---|---|---|---|---|
| 7,401,683 | B2 * | 7/2008 | Husmann | B66B 7/046 187/292 |
| 8,256,582 | B2 * | 9/2012 | Qiu | B66B 19/00 187/391 |
| 2002/0046906 | A1 * | 4/2002 | Grundmann | B66B 11/028 187/292 |
| 2002/0179377 | A1 * | 12/2002 | Higaki | B66B 7/044 187/292 |
| 2003/0111301 | A1 * | 6/2003 | Sittler | B66B 1/3484 187/393 |
| 2003/0226717 | A1 * | 12/2003 | Husmann | B66B 11/028 187/292 |
| 2004/0134716 | A1 * | 7/2004 | Martinelli | B66B 11/028 187/292 |
| 2004/0195047 | A1 * | 10/2004 | Wang | B66B 11/008 187/266 |
| 2013/0207811 | A1 * | 8/2013 | Yagawa | B65G 1/0421 340/691.6 |
| 2016/0068370 | A1 * | 3/2016 | Kyue | B66B 11/0226 187/401 |

* cited by examiner

METHOD AND ELEVATOR ARRANGEMENT

FIELD OF THE INVENTION

The invention relates to an elevator for transporting passengers and/or goods. More specifically, the invention relates to a method and an arrangement for balancing the car of an elevator.

BACKGROUND OF THE INVENTION

Elevator cars are conventionally formed to comprise a load-bearing frame structure, which is often referred to as a car sling, as well as a cabin box wherein the passengers and the goods are to be transported. Typically, the frame comprises a beam structure forming a rigid base frame on which components forming the cabin box are mounted. The components of the cabin box, typically at least the walls, the ceiling and the floor are typically fixed to each other such that a self-standing box-like structure is formed. The box-like structure is mounted to rest on top of the frame. Suspension of the car is provided via said frame by suspending the frame with ropes connected to the frame. The ropes are not directly connected to the cabin box and thus the cabin can be formed light-weighted whereas the frame is formed robust. The frame is typically shaped in accordance with the intended type of suspension. The frame can be such that it has a horizontal lower cross beam structure below the cabin box and a horizontal upper cross beam structure above the cabin box, and further upright beam structures on opposite sides of the cabin box connecting the upper and lower cross beam structure rigidly to each other. This is the most common structure for the frame structure, but of course, the frame can also be formed to have some alternative shape. In case the suspension is from top of the car, the frame typically comprises a horizontal upper cross beam structure above the cabin box where the suspension ropes are connected either by fixing the ends thereto or by passing under diverting pulleys mounted on the cross beam structure. In case the suspension is from bottom of the car, the frame typically comprises at least a horizontal lower cross beam structure below the cabin box where the suspension ropes are connected by passing under diverting pulleys mounted on the cross beam structure.

For various reasons, such as for increasing ride comfort, it is in some cases advantageous to isolate the cabin and the frame from each other such that they are not rigidly connected to each other in vertical direction. By isolating the cabin and frame with elastic members mounted between them, it can be achieved advantages in terms of ride comfort as well as service life of the car components, in particular guide means of the elevator car, such as guide rollers of guide sliders. In this way, vibrations can be reduced, for instance.

A drawback has been that the final car structure has not been adequately well balanced. Although a lot of work has been done for balancing the frame and the cabin box, the cabin box is often anyway in tilted position on the car due to the components, such as decoration panels and/or the toe guard, which are after the balancing locally supplied for the car. It has been noticed that this is because the isolated car has not been properly balanced on the site. This has caused that the ride comfort, especially with high-rise elevators, is heavily influenced by the static and dynamic balancing of the sling-cabin system. The compression of the elastic members between the cabin and the frame have been uneven, whereby the cabin travels in a tilted position. The tilted position of the cabin has triggered vibrations in itself, and these vibrations have been amplified by inertia and misalignments of the guide rails, for instance. For these reasons, a need for improved balancing of the car has come up.

BRIEF DESCRIPTION OF THE INVENTION

The object of the invention is, inter alia, to alleviate previously described drawbacks of known elevators and problems discussed later in the description of the invention. The object of the invention is particularly to introduce an improved method and an improved arrangement for balancing the elevator car. Advantageous embodiments are presented, inter alia, wherein a solution is provided wherein the car comprises a cabin box mounted on a rigid frame via elastic members and wherein the cabin box is accurately positioned even though components may have been installed thereon at a late stage in the installation or modification process of the car. Advantageous embodiments are presented, inter alia, wherein balancing of the cabin box can be done very accurately and simply.

It is brought forward a new method for balancing an elevator car comprising a frame; a cabin box mounted on the frame; and several elastic members, such as springs, in vertical direction between the frame and the cabin box, via which elastic members the cabin box rests on the frame. The method comprises measuring vertical distance between the frame and the cabin box in several horizontally spaced apart locations with distance sensors; and adjusting weight distribution of the cabin box. Said adjusting is preferably done by adding weight elements on the cabin box and/or removing weight elements mounted on the cabin box and/or repositioning weight elements mounted on the cabin box. Adjusting the weight distribution is done particularly based on the result of the measuring. The distance sensors are preferably, however not necessarily, mounted in said locations. In each said location a gap exists in vertical direction between the frame and the cabin box. With the method one or more of the above presented advantages and/or objects are facilitated. Particularly, the cabin box can be simply and accurately balanced with the method.

Said adjusting may comprise in addition, or even as an alternative, to said adding and/or removing, a step of repositioning weight elements that are already mounted on the cabin box, which step particularly preferably comprises changing the mounting location of weight elements at least in the horizontal direction.

Preferably, said adding and/or removing comprises adding and/or removing weight elements on top of the cabin box and/or on the walls of the cabin box, e.g. inside cavities within the wall(s) and/or attached on the back side of the wall that faces the hoistway.

Preferably, before the above mentioned steps, the method comprises a step of mounting said several distance sensors in vertical direction between the frame and the cabin box in several horizontally spaced apart locations.

Preferably, said adjusting comprises adjusting weight distribution of the cabin box until measured vertical distances between the frame and the cabin box in said several locations are as desired. Particularly, said adjusting comprises adjusting weight distribution of the cabin until measured vertical distances between the frame and the cabin box in said several locations are at least substantially the same with each other or each measured vertical distance is at least substantially the same as a predetermined reference value or falls within a predetermined reference range.

Preferably, said measuring is continuous or it is repeated one or more times. Said adjusting can also be repeated one or more times.

Preferably, the method further comprises comparing the measured vertical distances with each other or with a predetermined reference value or a predetermined reference range.

Preferably, said adjusting weight distribution of the cabin is done by adding and/or repositioning and/or removing weight elements on the cabin box in locations horizontally spaced apart from the center of the vertical projection of the cabin box, preferably at a horizontal distance from the center, which is more than 50 cm. Thus, additional weight caused by the weight elements has a meaningful balancing effect with only small addition to total weight of the car. This way, also the effect is easy to control.

Preferably, the car is balanced in the defined way while it hangs in a hoistway suspended by ropes of the elevator.

Preferably, after the adjustment, and before the car is taken into use for transporting passengers the distance sensors are removed from the car.

It is also brought forward a new arrangement for balancing an elevator car, the elevator car comprising a frame; a cabin box mounted on the frame; and several elastic members, such as springs, in vertical direction between the frame and the cabin box, via which elastic members the cabin box rests on the frame. The elastic members thereby form an elastic support for the cabin box, each of them supporting the cabin box vertically and allowing vertical movement between the frame and the cabin box. The arrangement comprises several distance sensors mounted in several horizontally spaced apart locations in vertical direction between the frame and the cabin box for sensing the vertical distance between the frame and the cabin box in said locations. In each said location a gap exists in vertical direction between the frame and the cabin box. With the method one or more of the above presented advantages and/or objects are facilitated. Particularly, the cabin box can be simply and accurately balanced with the method.

Preferably, the arrangement further comprises weight elements mounted on the cabin box and/or for being added on and/or removed from the cabin box.

Preferably, in the arrangement and/or the method for balancing said elastic members are springs or equivalent.

Preferably, in the arrangement and/or the method for balancing said several horizontally spaced apart locations form tips of a polygon when viewed from above.

Preferably, in the arrangement and/or the method for balancing the center of vertical projection of the cabin is within the polygon.

Preferably, in the arrangement and/or the method for balancing said several horizontally spaced apart locations of the distance sensors are vertically at substantially same level.

Preferably, in the arrangement and/or the method for balancing said elastic members are mounted in horizontally spaced apart locations, preferably vertically at substantially same level.

Preferably, in the arrangement and/or the method for balancing each of said several horizontally spaced apart locations is adjacent to one of said elastic members.

Preferably, in the arrangement and/or the method for balancing a display unit is connected to each of said distance sensors. The display is preferably configured to display the result of the sensing, in particular the distance measured by each distance sensor. Preferably, there is only that one display unit, however alternatively there may be more display units, e.g. one for each sensor for displaying the result of the sensing of that sensor.

Preferably, in the arrangement and/or the method for balancing in each said location a gap exists between an upper face of the frame and a lower face of the cabin box in vertical direction, the sensors being configured to sense the vertical distance between the upper face of the frame and the lower face of the cabin box. Preferably, said upper face of the frame and said lower face of the cabin box are both horizontal.

Preferably, in the arrangement and/or the method for balancing each said upper face of the frame is an upper face of a horizontal beam of the frame, and each said lower face of the cabin box is a lower face of a horizontal beam of the cabin box.

Preferably, in the arrangement and/or the method for balancing in each said location a gap exists between an upper face of the frame and a lower face of the cabin box in vertical direction, the sensor being mounted to rest on top of the upper face of the frame within the gap.

Preferably, in the arrangement and/or the method for balancing in each said location the gap is higher than the height of the sensor mounted in that location, the sensors being configured to sense the distance between the frame and the cabin box, i.e. the height of the gap g existing between them in vertical direction, without contacting the lower face of the cabin box.

Preferably, in the arrangement and/or the method for balancing the distance sensors are contactless distance sensors, i.e. sensors that can remotely measure the distance to the target. For this purpose, the sensors are preferably of the type sending a beam of electromagnetic radiation. Preferably, the distance sensors are laser-sensors.

Preferably, in the arrangement and/or the method for balancing the frame forms a rigid structure surrounding the cabin box.

Preferably, in the arrangement and/or the method for balancing the elevator car hangs in a hoistway suspended by ropes connected to the frame.

The elevator arrangement is preferably further such that the car thereof is to serve two or more landings. While in use, the elevator preferably controls movement of the car in response to calls from landing and/or destination commands from inside the cabin box of the car so as to serve persons on the landing(s) and/or inside the elevator cabin box. Preferably, the cabin box of the car has an interior space suitable for receiving a passenger or passengers, and provided with walls, ceiling and floor, and preferably also with an openable door for forming an interior space, which can be opened and closed.

BRIEF DESCRIPTION OF THE DRAWINGS

In the following, the present invention will be described in more detail by way of example and with reference to the attached drawings, in which.

The foregoing aspects, features and advantages of the invention will be apparent from the drawings and the detailed description related thereto.

DETAILED DESCRIPTION

Figure 1:
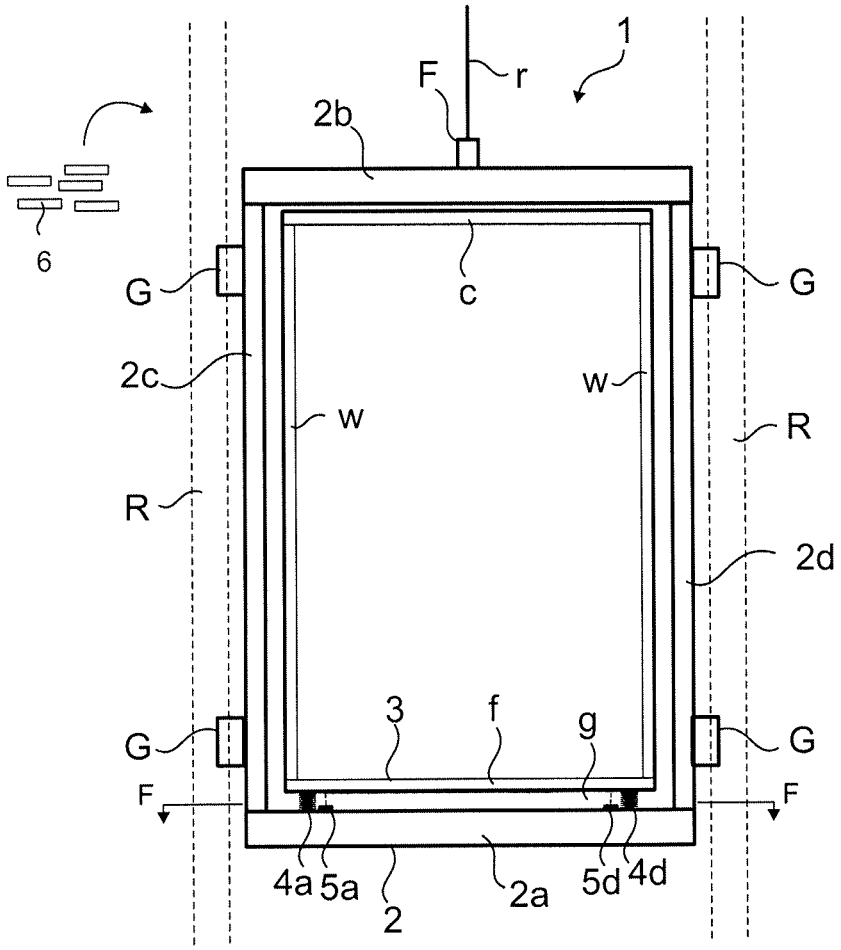
FIG. 1 illustrates schematically an elevator arrangement according to the invention wherein the method according to the invention is implemented.
Figure 2:
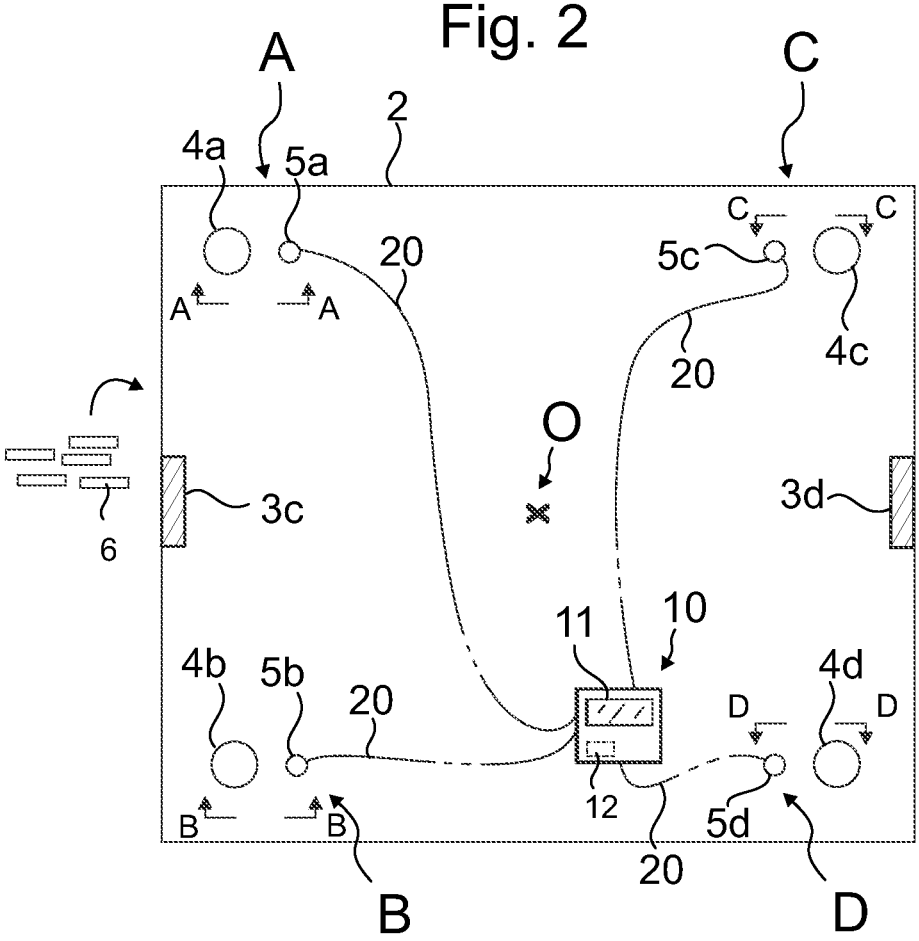
FIG. 2 illustrates a sectional view F-F of FIG. 1.

FIGS. 1 and 2 illustrate an arrangement for balancing an elevator car 1, the elevator car comprising a frame 2 and a cabin box 3 mounted on the frame 2, and a plurality of elastic members 4*a*,4*b*,4*c*,4*d*, in particular springs, mounted in vertical direction between the frame 2 and the cabin box 3, via which elastic members 4*a*,4*b*,4*c*,4*d* the cabin box 3 rests on the frame 2. The elastic members 4*a*,4*b*,4*c*,4*d* together form an elastic support for the cabin box 3. Particularly, each elastic members 4*a*,4*b*,4*c*,4*d* supports the cabin box 3 vertically and allows vertical movement between the frame 2 and the cabin box 3. Thereby slight tilting movement between the frame 2 and cabin box 3 is possible. The elastic members isolate the cabin 3 and the frame 2 from each other such that they are not rigidly connected to each other in vertical direction.

In this case, the car 1 is of the type where the frame 2 comprises forms a rigid base frame 2 on which components forming the cabin box 3 are mounted. The components of the cabin box 3, in this case at least the walls w, the ceiling c and the floor f are preferably fixed to each other such that a hollow self-standing box-like structure is formed. The box-like structure is mounted to rest on top of the frame 2 via said elastic members 4*a*,4*b*,4*c*,4*d*.

The frame 2 is in this case such that it has a horizontal lower cross beam structure 2*a* below the cabin box 3 and a horizontal upper cross beam structure 2*b* above the cabin box 3, and further upright beam structures 2*c*,2*d* on opposite sides of the cabin box connecting the upper and lower cross beam 2*b*, 2*a* structure rigidly to each other. Of course, the frame 2 can alternatively be formed to have some other shape. Suspension of the car 1 is provided via said frame 2 by suspending the frame 2 with ropes r connected to the frame 2. In this case, the suspension point F is provided on top of the car 1 by fixing the ends of the ropes r to the horizontal upper cross beam structure 2*b* above the cabin box 3. Of course, alternatively the suspension point could be provided elsewhere, such as below the car 1.

The arrangement comprises several distance sensors 5*a*,5*b*,5*c*,5*d* mounted in several horizontally spaced apart locations A,B,C,D between the frame 2 and the cabin box 3 for sensing the vertical distance between the frame 2 and the cabin box 3 in said location. In each said location A,B,C,D a gap g exists between the frame 2 and the cabin box 3 in vertical direction.

The elastic members 4*a*,4*b*,4*c*,4*d* are preferably springs, as illustrated. In particular, they are preferably in the form of helical springs but could alternatively be some other type of springs such as leaf springs, Belleville springs or gas springs. As a yet further alternative, the elastic members 4*a*,4*b*,4*c*,4*d* could be for instance blocks made of elastic material, such as blocks made of elastomer, for instance rubber. As a yet further alternative, the elastic members 4*a*,4*b*,4*c*,4*d* could be a combination of two or more of the examples mentioned.

Said several horizontally spaced apart locations A,B,C,D are preferably such that they form tips of a polygon when viewed from above. This is facilitates comprehensive balancing as in this way the balancing can be done in all directions. For this end, said several horizontally spaced apart locations A, B,C, D include at least three locations which form tips of a polygon (a polygon of at least 3 tips, i.e. at least triangular) when viewed from above. In the embodiment illustrated in FIGS. 1 and 2, said several horizontally spaced apart locations A,B,C,D include four locations which form tips of a tetragon when viewed from above. Thus, said locations are easy to choose and one location can be assigned in each of the four corners of the cars tetragonal vertical projection. Preferably, the center O of vertical projection of the cabin box is within the polygon. This facilitates accuracy balancing, particularly because the horizontal distance between the locations can simply be set long.

For facilitating accurate measurement and in the end more accurate balancing said several horizontally spaced apart locations A,B,C,D are preferably at a horizontal distance from each other, which is more than 50 cm, more preferably more than 1 meter. Said several horizontally spaced apart locations are preferably vertically at substantially same level as illustrated in Figures. Thereby, positioning of the sensors as well as control of the method is simple.

As mentioned, in each said location A,B,C,D a gap g exists between the frame 2 and the cabin box 3 in vertical direction. In the preferred embodiment illustrated in FIG. 1, each gap g under inspection is a gap formed below the cabin 3. In this embodiment, in each said location a gap g exists more specifically between an upper horizontal face of the frame 2 and a lower horizontal face of the cabin box 3, and the sensors 5*a*,5*b*,5*c*,5*d* are configured to sense the distance between the upper horizontal face of the frame 2 and the horizontal lower face of the cabin box 3, i.e. the height of the gap g existing between these faces in vertical direction. In practice, the solution is most easy to implement, when in each said location the gap g exists between a upper face of a horizontal beam of the frame 2 and a lower face of a horizontal beam of the cabin box 3, the sensors then being configured to sense the distance between said faces and thereby the distance between said beams. The elements between which the gap is measured, are thus rigid elements whereby reliable and accurate measurement can be obtained.

Each of the sensors 5*a*,5*b*,5*c*,5*d* is preferably arranged to measure the vertical distance between the frame 2 and the cabin box 3, i.e. the height of the gap g existing between them in vertical direction, while being inside the gap g. For this purpose, it is preferable that each sensor 5*a*,5*b*,5*c*,5*d* is mounted to rest on top of the upper face of the frame 2 within the gap g. As visible from FIGS. 1 and 3, in each said location the gap g is higher than the height of the sensor 5*a*,5*b*,5*c*,5*d*, and each of the sensors 5*a*,5*b*,5*c*,5*d* is configured to sense the height of the gap g where it is mounted without contacting the lower face of the cabin box 3. For this purpose the sensors 5*a*,5*b*,5*c*,5*d* are preferably contactless distance sensors, i.e. sensors that can remotely measure the distance to the target. For this purpose, the sensors are preferably of the type sending a beam b of electromagnetic radiation. The sensors are most preferably laser-sensors, which are known to provide accurate results. However several different alternative solutions are commercially available such as ultrasonic or microwave sensors etc., one of which can alternatively be used.

Said plurality of elastic members 4*a*,4*b*,4*c*,4*d* are preferably, but not necessarily, mounted in horizontally spaced apart locations. In this way, they provide the cabin box a stabile yet elastic support.

Preferably, the elastic members 4*a*,4*b*,4*c*,4*d* are mounted mutually at substantially same level in vertical direction as illustrated.

In the preferred embodiment, each of said several horizontally spaced apart locations A,B,C,D, wherein a distance sensors 5*a*,5*b*,5*c*,5*d* is mounted for measuring the distance in that location, is adjacent to one of said elastic members 4*a*,4*b*,4*c*,4*d*. Thus, each sensor 5*a*,5*b*,5*c*,5*d* is mounted adjacent to one of said elastic members 4*a*,4*b*,4*c*,4*d*, this meaning that the sensors are apart from the elastic members 4*a*,4*b*,4*c*,4*d* a horizontal distance which is not more than 20 cm. Thus, accuracy of the measurement is facilitated as the distance can be measured close to the point where dimensional changes resulting from tilting of the cabin box 3 are most likely greatest and easily detectable.

For providing easy reading of the results of the measurements, the arrangement comprises a display unit 10 as illustrated in FIG. 2. The display unit 10 is connected, e.g. by wires or wirelessly to each of said distance sensors 5*a*,5*b*,5*c*,5*d* to display the result of the sensing, in particular the distance measured by each distance sensor 5*a*,5*b*,5*c*,5*d*. The display unit 10 is preferably located or at least accessible from on top of the car or from the landing at least for the duration of the method for balancing the car 1. It is preferably not fixedly mounted on the cabin box 3 whereby it can be easily used without causing disturbances on the measured values. At simplest, the display unit 10 comprises at least a display 11 for displaying the result of the sensing of all the sensors 5*a*,5*b*,5*c*,5*d*. Then, the display unit 10 is preferably configured to display the result of the sensing of all the sensors 5*a*,5*b*,5*c*,5*d* simultaneously, and based on this, the user can adjust weight distribution of the cabin box 3 by adding weight elements 6 on the cabin box 3 and/or removing weight elements 6 mounted on the cabin box 3 and/or repositioning weight elements 6 already mounted on the cabin box 3, so as to alter the balance of the cabin box 3 to be as desired. In a more complicated implementation, the display unit 10 can comprise a computer 12 for carrying out calculations based on the measurements received from the distance sensors 5*a*,5*b*,5*c*,5*d*. The calculation may include calculating how the weight of the cabin box 3 should be adjusted so as to reach a balance situation.

In the arrangement for balancing an elevator car 1, the elevator car 1 preferably hangs in a hoistway H suspended by ropes R connected of the frame 2 and the cabin box 3 only to the frame 2 that carrying the cabin box 3 via the elastic members 4*a*,4*b*,4*c*,4*d*. Thus, the car is balanced in the same state in which it will serve its final purpose. This is also advantageous, because in this way the car 1 can is balanced at a late stage, which is beneficial, because the car 1 may need to be modified late in the process for installing the elevator, such as after the car 1 has already been installed to hang in the hoistway. For example, decorative wall panels of the cabin box 1, as well as door structures may need to be installed at a very late stage of the process. These involve adding weight to the cabin box 3, whereby the balance thereof is changed as well. Should the balancing be carried out earlier it is affected by all the later modifications done to the cabin box 3.

The frame 2 may be structurally of any known kind suitable to carry the cabin box 3 as disclosed. In the preferred embodiment shown, the frame 2 forms a ring-like rigid structure surrounding the cabin box 3, whereby suspension either from top or from bottom of the car 1 can be easily arranged.

Figure 3:
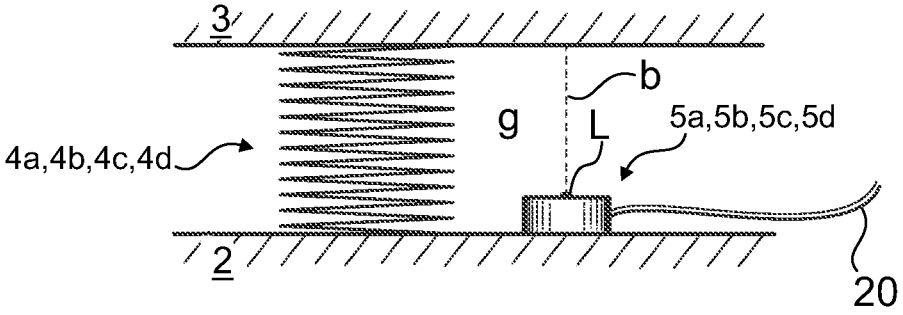
FIG. 3 illustrates a sectional view A-A, B-B, C-C and D-D of FIG. 2.

The arrangement described above implements a method for balancing an elevator car 1. Referring still to FIGS. 1 to 3, in the method for balancing an elevator car 1, the car comprises a frame 2, a cabin box 3 mounted on the frame 2 and a plurality of elastic members 4*a*,4*b*,4*c*,4*d*, such as springs, in vertical direction between the frame 2 and the cabin box 3, via which elastic members 4*a*,4*b*,4*c*,4*d* the cabin box 3 rests on the frame 2. The elastic members 4*a*,4*b*,4*c*,4*d* form an elastic support for the frame, and each of them supports the cabin box vertically and allows vertical movement between the frame 2 and the cabin box 3. Thereby tilting movement between the frame and cabin box is possible. The method comprises a step of measuring vertical distance between the frame 2 and the cabin box 3 in several horizontally spaced apart locations with distance sensors 5*a*,5*b*,5*c*,5*d*, the sensors preferably, but not necessarily, being mounted in said locations A,B,C,D. The method further comprises after this adjusting weight distribution of the cabin box by one or more of the following: adding weight elements 6 on the cabin box 3, removing weight elements 6 mounted on the cabin box 3, repositioning weight elements 6 already mounted on the cabin box 3. Said adding preferably comprises mounting weight elements 6 on the cabin box 3. Said adjusting is done based on results of said measuring. Said measuring could be carried out only once but preferably said measuring is either continuous or repeated one or more times during the method, in particular during the adjusting step. By continuous or repeated measuring during and/or after the adjusting, feedback of the adjusting is given for the user, and adjusting can be continued based on the feedback. In each said location A,B,C,D a gap g exists between the frame 2 and the cabin box 3 in vertical direction. In the preferred embodiment illustrated in FIG. 1, each gap g under inspection is a gap formed below the cabin 3. In this embodiment, in each said location a gap g exists more specifically between an upper horizontal face of the frame 2 and a lower horizontal face of the cabin box 3, and the sensors 5*a*,5*b*,5*c*,5*d* are configured to sense the distance between the upper horizontal face of the frame 2 and the horizontal lower face of the cabin box 3, i.e. the height of the gap g existing between these faces in vertical direction. Said adjusting may in addition or even as an alternative to said adding and/or removing comprise repositioning weight elements 6 already mounted on the cabin box 3, which step particularly preferably comprises changing the mounting location of weight elements at least in the horizontal direction.

Said adding and/or removing preferably comprises adding and/or removing weight elements 6 on top of the cabin box 3 and/or on the walls of the cabin box 3, in which case the weight elements 6 are most preferably inserted inside cavities within the wall(s) and/or attached on the back side of the wall(s) that face(s) the hoistway H.

The method preferably comprises also a step of mounting said several distance sensors 5*a*,5*b*,5*c*,5*d* between the frame 2 and the cabin box 3 in said several horizontally spaced apart locations A,B,C,D.

In the method said adjusting comprises adjusting weight distribution of the cabin box 3 until measured vertical distances between the frame 2 and the cabin box 3 in said several locations are as desired.

There are several ways to determine when no more adjustment is needed. In the first, and most preferred alternative, said adjusting comprises adjusting weight distribution of the cabin box 3 by adding and/or removing weight elements 6 on the cabin box 3 until measured vertical distances between the frame 2 and the cabin box 3 in said several locations A,B,C,D are at least substantially the same with each other. Then, the method further preferably comprises a step of comparing the measured vertical distances with each other. In the second alternative, said adjusting comprises adjusting weight distribution of the cabin box 3 by adding and/or removing weight elements 6 on the cabin box 3 until each measured vertical distance is at least substantially the same as a predetermined reference value. Then, the method further preferably comprises a step of comparing each measured vertical distance with a reference value. In the third alternative, said adjusting comprises adjusting weight distribution of the cabin box 3 by adding and/or removing weight elements 6 on the cabin box 3 until each measured vertical distance falls within a predetermined reference range. Then, the method further preferably comprises a step of comparing each measured vertical distance with a predetermined reference range.

For providing easy reading of the results of the measurements, the method preferably comprises presenting data on a display 11 based on said measuring. At simplest, the presenting data comprises presenting on a display 11 the distance values measured by each of said distance sensors 5*a*,5*b*,5*c*,5*d*. In a more complicated implementation, calculations are carried out on a computer 12 based on the measurements received from the distance sensors 5*a*,5*b*,5*c*, 5*d*. In this case, the calculations preferably include calculating how the weight of the cabin box 3 should be adjusted so as to reach a balance situation. Thereafter, the result data of this calculation is presented on the display 11, whereby in this case the presenting data comprises presenting on a display 11 instructions on how to adjust the weight balance, in particular where to add and/or remove weight elements and the amount to be added and/or removed.

Said adjusting weight distribution of the cabin is preferably done by adding and/or removing and/or repositioning weight elements 6 on the cabin box 3 in one or several locations horizontally spaced apart from the center O of the vertical projection of the cabin box 3, preferably at a horizontal distance the center O, which is more than 50 cm. Thus, additional weight caused by the weight elements 6 has a meaningful balancing effect with only small addition to total weight of the car 1. This way, also the effect is easy to control. Said several locations may include locations horizontally spaced apart from each other. Said adjusting can be implemented e.g. by adjusting the weight distribution such that mass of the weight elements 6 is increased at the location of the car 1 where the measured vertical distance is greatest and/or decreased at the location of the car 1 where the measured distance is shortest.

In the method, the car 1 is preferably balanced in the defined way while it hangs in a hoistway H suspended by ropes R of the elevator. Particularly, it is preferable that the elevator car 1 is balanced in the defined way while it hangs in a hoistway H suspended by ropes R connected of the frame 2 and the cabin box 3 only to the frame 2 that carrying the cabin box 3 via the elastic members 4*a*,4*b*,4*c*,4*d*. Thus, the car is balanced in the same state in which it will serve its final purpose. This is also advantageous, because in this way the car 1 can is balanced at a late stage, which is beneficial for the reasons given earlier above. After the adjustment, and before the car 1 is taken into use the distance sensors 5*a*,5*b*,5*c*,5*d* are removed from the car 1.

Figure 4:
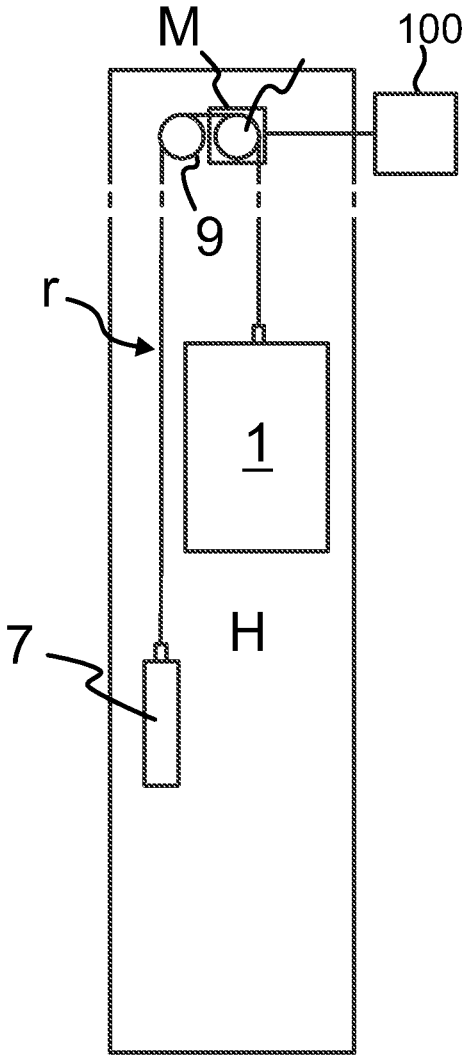
FIG. 4 illustrates further preferred details for the elevator arrangement of FIG. 1.

FIG. 4 illustrates the surroundings of FIG. 1, as preferred. In this case, the elevator arrangement is already usable for transporting passengers and comprises a hoistway H, an elevator car 1 vertically movable in the hoistway H, and a counterweight 7 vertically movable in the hoistway H. The arrangement comprises one or more upper rope wheels 8,9 mounted higher than the car 1 and counterweight 2, in particular in proximity of the upper end of the hoistway H. In this case, there are two of said rope wheels 8,9. The arrangement further comprises ropes r interconnecting the elevator car 1 and counterweight 2, each of said one or more ropes r passing around said upper rope wheels 8,9. The ropes r suspend the car 1 and counterweight 7 on opposite sides of said upper rope wheels 8,9. Preferably, said one or more upper rope wheels 8,9 comprises a drive wheel 9 engaging said ropes, and the elevator further comprises a motor M for rotating the drive wheel 9. Thus, the elevator car 1 can be moved. The arrangement further comprises an automatic elevator control 100 arranged to control the motor M, whereby rotation of the drive wheel 9 and thereby also the movement of the car 1 is automatically controllable. The elevator arrangement comprises guide rails R for guiding the car 1 via guide means G mounted on the car 1, in particular on the frame 2 thereof. In the method the elevator is arranged to be as above described.

It is to be understood that in the Figures, the car frame 2 and the cabin box 3 are illustrated schematically only. In practice, the horizontal lower cross beam structure 2*a* of the car frame 2 need not form a uniform plane as illustrated in FIG. 2 merely for the sake of clarity, but instead a structure of several interconnected beams, which may be sparsely positioned relative to each other.

In the application with the term several it is meant a plurality, in particular at least two, but possibly more, such as three, four, five, six or even more.

It is to be understood that the above description and the accompanying Figures are only intended to teach the best way known to the inventors to make and use the invention. It will be apparent to a person skilled in the art that the inventive concept can be implemented in various ways. The above-described embodiments of the invention may thus be modified or varied, without departing from the invention, as appreciated by those skilled in the art in light of the above teachings. It is therefore to be understood that the invention and its embodiments are not limited to the examples described above but may vary within the scope of the claims and their equivalents.

The invention claimed is:

1. A method for balancing an elevator car, the elevator car comprising:

a frame;

a cabin box mounted on the frame; and several elastic members arranged in a vertical direction between the frame and the cabin box, via which elastic members the cabin box rests on the frame, the method comprising the steps of:

measuring a vertical distance between the frame and the cabin box in several horizontally spaced apart locations with distance sensors; and adjusting a weight distribution of the cabin box based on the measured vertical distance at the several horizontally spaced apart locations.

2. The method according to claim 1, wherein said adjusting the weight distribution of the cabin box comprises the step of adding weight elements on the cabin box and/or removing weight elements mounted on the cabin box and/or repositioning weight elements mounted on the cabin box.

3. A method according to claim 2, wherein the method comprises the step of mounting said several distance sensors in the vertical direction between the frame and the cabin box in said several horizontally spaced apart locations.

4. The method according to claim 2, wherein said adjusting comprises the step of adjusting the weight distribution of the cabin box until measured vertical distances between the frame and the cabin box in said several locations are as desired.

5. The method according to claim 1, wherein the method comprises the step of mounting said several distance sensors in the vertical direction between the frame and the cabin box in said several horizontally spaced apart locations.

6. The method according to claim 1, wherein said adjusting comprises the step of adjusting the weight distribution of the cabin box until measured vertical distances between the frame and the cabin box in said several locations are as desired.

7. The method according to claim 1, wherein said measuring is continuous or is repeated one or more times.

8. The method according to claim 1, wherein said adjusting comprises the step of adjusting the weight distribution of the cabin box until measured vertical distances between the frame and the cabin box in said several locations are at least substantially the same with each other or until each measured vertical distance is at least substantially the same as a predetermined reference value or until each measured vertical distance falls within a predetermined reference range.

9. The method according to claim 1, wherein the method further comprises the step of comparing the measured vertical distances with each other or with a predetermined reference value or a predetermined reference range.

10. The method according to claim 1, wherein said adjusting weight distribution of the cabin box is done by adding and/or removing and/or repositioning weight elements on the cabin box in locations horizontally spaced apart from the center of the vertical projection of the cabin box.

11. The method according to claim 1, wherein said elastic members are springs or equivalent.

12. The method according to claim 1, wherein said several horizontally spaced apart locations together form the edges of a polygon when viewed from above.

13. The method according to claim 1, wherein each of said several horizontally spaced apart locations is adjacent to one of said elastic members.

14. The method according to claim 1, wherein a display unit is connected to each of said distance sensors to display the result of the sensing.

15. The method according to claim 1, wherein in each said location a gap exists between an upper face of the frame and a lower face of the cabin box in the vertical direction, the sensors being configured to sense the vertical distance between the upper face of the frame and the lower face of the cabin box.

16. The method according to claim 1, wherein in each said location a gap exists between an upper face of the frame and a lower face of the cabin box in the vertical direction, the sensor being mounted to rest on top of the upper face of the frame within the gap.

17. The method according to claim 1, wherein said several horizontally spaced apart locations together form the edges of a polygon when viewed from above, the center of a vertical projection of the cabin box being within the polygon.

18. The method according to claim 1, wherein a display unit is connected to each of said distance sensors to display the result of the distance measured by each distance sensor.

19. An arrangement for balancing an elevator car, the elevator car comprising:

a frame;

a cabin box mounted on the frame;

several elastic members arranged in a vertical direction between the frame and the cabin box, via which elastic members the cabin box rests on the frame; and several distance sensors mounted in several horizontally spaced apart locations between the frame and the cabin box for sensing the vertical distance between the frame and the cabin box in said locations.

20. The arrangement for balancing an elevator car of claim 19, further comprising a plurality of removable weight elements located on the cabin box; and a computer configured to calculate the repositioning and/or removal of said plurality of removable weight elements and/or the addition of further removable weight elements on said cabin box, such that said vertical distance in said locations is substantial equal to a predetermined reference value.

* * * * *